US011247260B1

(12) United States Patent
Othman

(10) Patent No.: US 11,247,260 B1
(45) Date of Patent: Feb. 15, 2022

(54) TUBE CONNECTOR CRIMPING TOOL

(71) Applicant: Emad Othman, Whittier, CA (US)

(72) Inventor: Emad Othman, Whittier, CA (US)

( * ) Notice: Subject to any disclaimer, the term of this patent is extended or adjusted under 35 U.S.C. 154(b) by 0 days.

(21) Appl. No.: 17/016,958

(22) Filed: Sep. 10, 2020

Related U.S. Application Data

(60) Provisional application No. 62/898,157, filed on Sep. 10, 2019.

(51) Int. Cl.
*B21D 39/04* (2006.01)
*B25B 27/10* (2006.01)

(52) U.S. Cl.
CPC ..... *B21D 39/048* (2013.01); *B21D 39/046* (2013.01); *B25B 27/10* (2013.01)

(58) Field of Classification Search
CPC ..... B21D 39/048
USPC ..... 29/282
See application file for complete search history.

(56) References Cited

U.S. PATENT DOCUMENTS

| | | | | |
|---|---|---|---|---|
| 2,361,971 | A * | 11/1944 | Shipman | B25B 27/22 59/7 |
| 5,099,561 | A * | 3/1992 | Santiago Lozano | B25B 5/02 269/127 |
| 2010/0175516 | A1* | 7/2010 | Zhang | B25B 7/02 81/402 |
| 2018/0264634 | A1* | 9/2018 | Yontz | B25B 7/02 |
| 2018/0290276 | A1* | 10/2018 | Wu | B25B 7/02 |
| 2019/0240821 | A1* | 8/2019 | Wetzel | B25B 25/005 |

* cited by examiner

*Primary Examiner* — Lee D Wilson
*Assistant Examiner* — Jonathan G Santiago Martinez
(74) *Attorney, Agent, or Firm* — Plager Schack LLP; Mark H. Plager; Michael J. O'Brien

(57) ABSTRACT

A tube connector crimping tool is configured to enable a user to crimp a first refrigeration tube having a first connector cap to a second refrigeration tube having a second connector cap with one hand. The tube connector crimping tool has a first handle arm joined to a first handle head. A clamp head tongue is joined to the first handle head and clamp head teeth. a gear IS immediately adjacent to the clamp head teeth and joined to a ratchet. A second handle head is joined to the ratchet and a second handle arm. Squeezing the second handle arm toward the first handle arm crimps the first refrigeration tube to the second refrigeration tube.

5 Claims, 4 Drawing Sheets

TUBE CONNECTOR CRIMPING TOOL

RELATED APPLICATION

This application claims priority to provisional patent application U.S. Ser. No. 62/898,157 filed on Sep. 10, 2019, the entire contents of which is herein incorporated by reference.

BACKGROUND

The embodiments herein relate generally to equipment used to make repairs to refrigeration systems.

Prior to embodiments of the disclosed invention two hands were needed to replace an R600a freon line in a refrigerator. Embodiments of the disclosed invention solve this problem.

SUMMARY

A tube connector crimping tool is configured to enable a user to crimp a first refrigeration tube having a first connector cap to a second refrigeration tube having a second connector cap with one hand. The tube connector crimping tool has a first handle arm joined to a first handle head. A clamp head tongue is joined to the first handle head and clamp head teeth. a gear IS immediately adjacent to the clamp head teeth and joined to a ratchet. A second handle head is joined to the ratchet and a second handle arm. Squeezing the second handle arm toward the first handle arm crimps the first refrigeration tube to the second refrigeration tube.

The first clamp head further comprises a first clamp head upper opening and a first clamp head lower opening. The first clamp head further comprises a first connector cap slot, immediately adjacent to the first connector cap. The first clamp head further comprises a tube slot immediately adjacent to the first tube.

In some embodiments, a first large pivot pin is inserted through a first handle large upper opening and a first clamp head upper opening and held in place with a first large retaining ring. A first small pivot pin is inserted through a first handle small lower opening and a first clamp head lower opening and held in place with a first small retaining ring.

In some embodiments, a second large pivot pin is inserted through a second handle large upper opening and a second clamp head upper opening and held in place with a second large retaining ring. The ratchet is arranged through a second handle first small lower opening.

In some embodiments, a pawl further comprises a pawl body with a pawl tooth and joined to a pawl arm. A second small pivot pin is arranged through a second handle second small lower opening, a pawl spacer, and the pawl body and held in place with a second small retaining ring.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
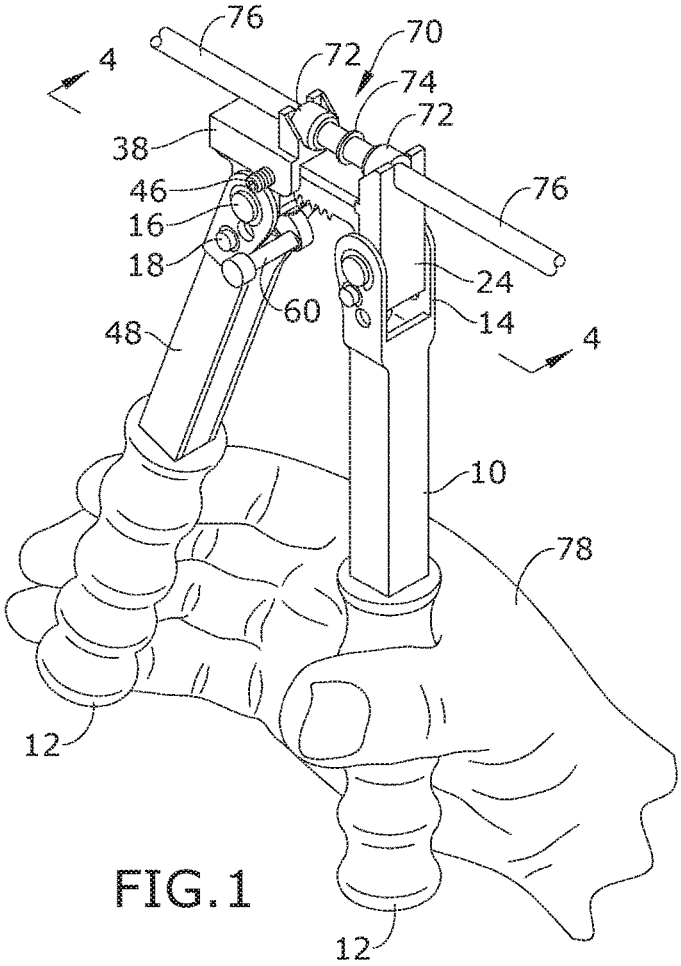
FIG. 1 shows a perspective view of one embodiment of the present invention shown in use.
Figure 2:
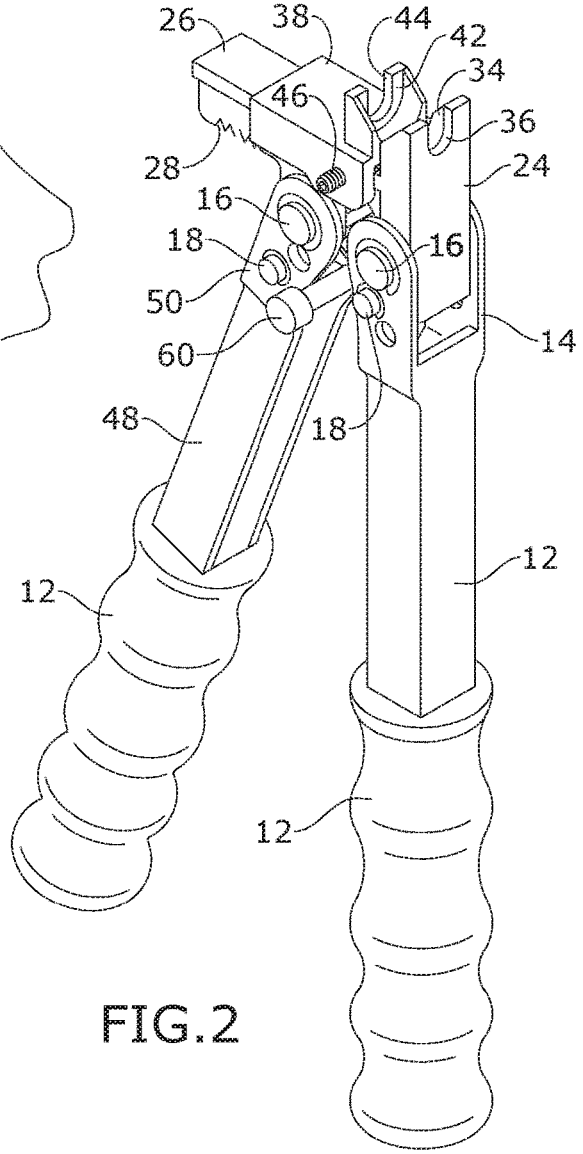
FIG. 2 shows a perspective view of one embodiment of the present invention.
Figure 3:
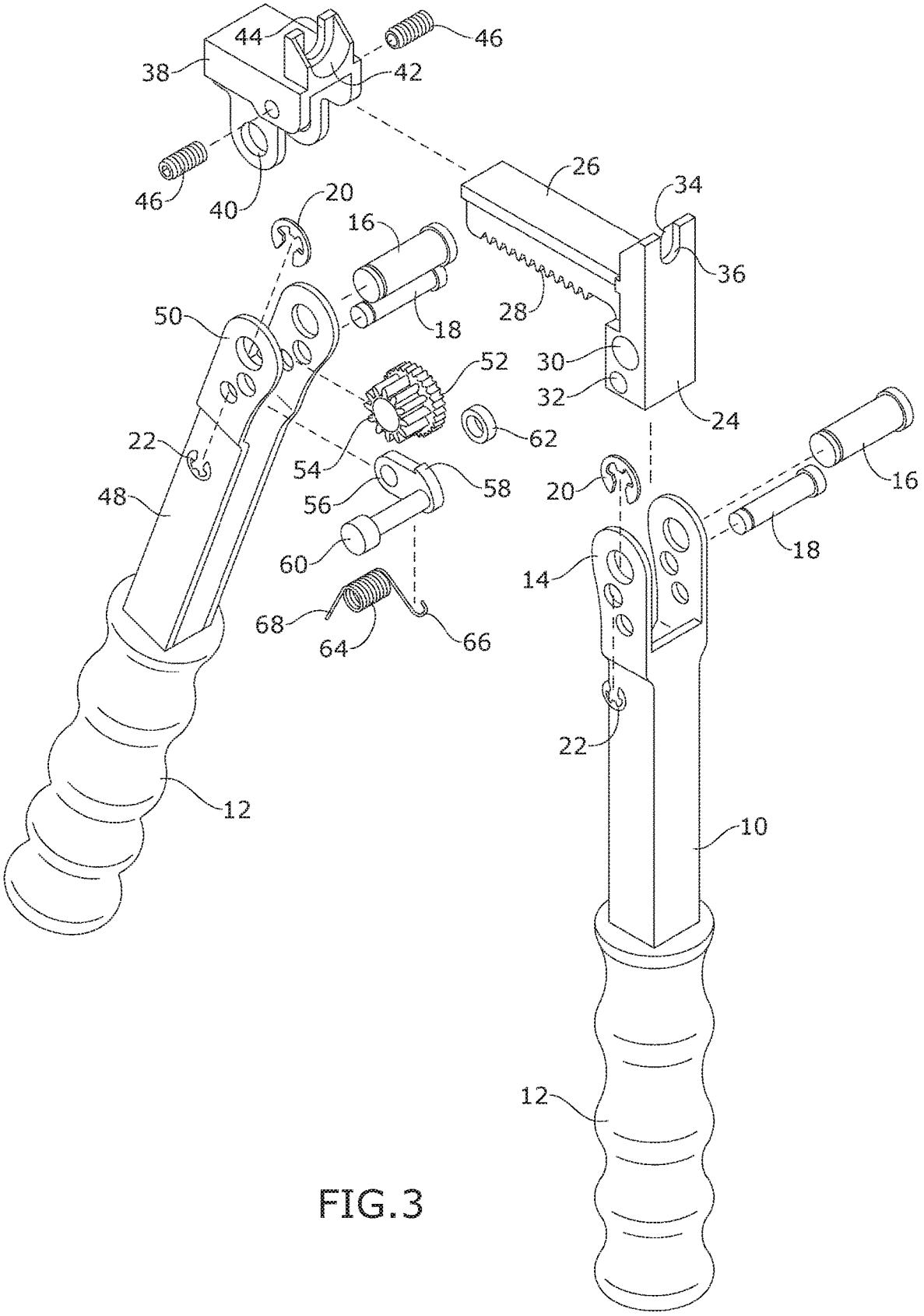
FIG. 3 shows an exploded view of one embodiment of the present invention shown in use.
Figure 4:
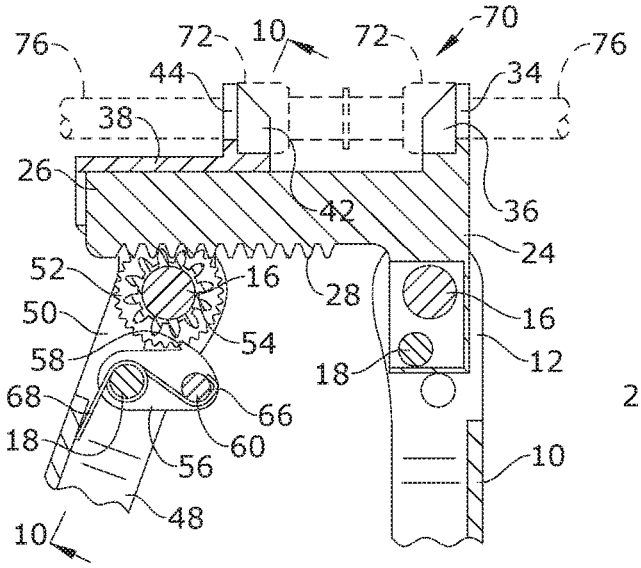
FIG. 4 shows a section view of one embodiment of the present invention taken along line 4-4 in FIG. 1.
Figure 5:
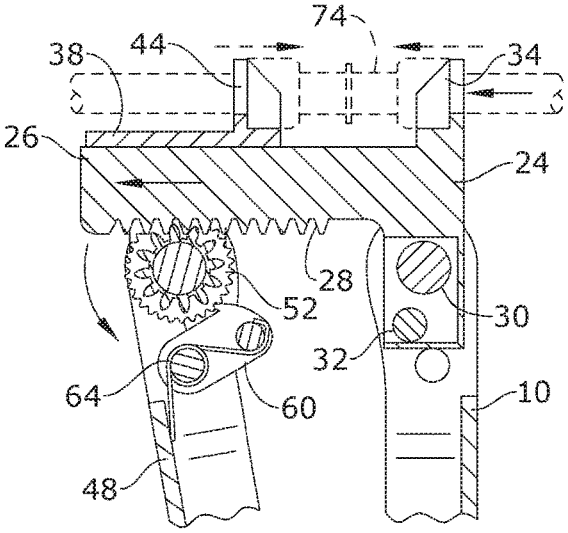
FIG. 5 shows a section view of one embodiment of the present invention.
Figure 6:
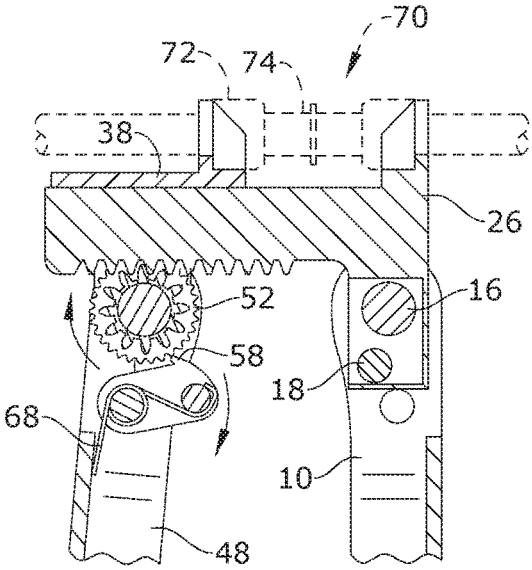
FIG. 6 shows a section view of one embodiment of the present invention.
Figure 7:
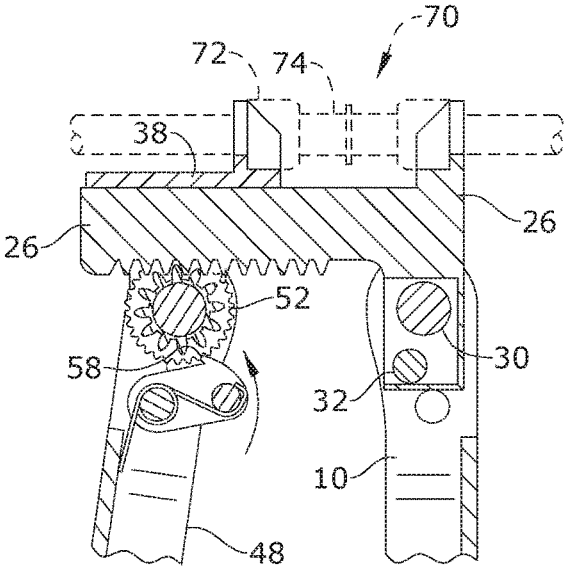
FIG. 7 shows a section view of one embodiment of the present invention.
Figure 8:
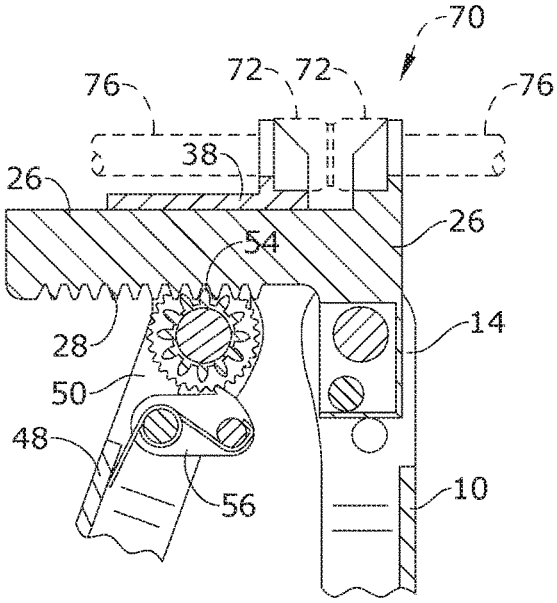
FIG. 8 shows a section view of one embodiment of the present invention.
Figure 9:
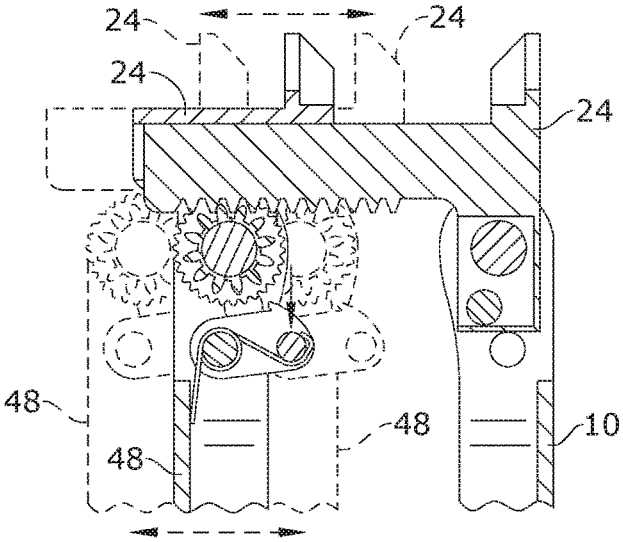
FIG. 9 shows a section view of one embodiment of the present invention.
Figure 10:
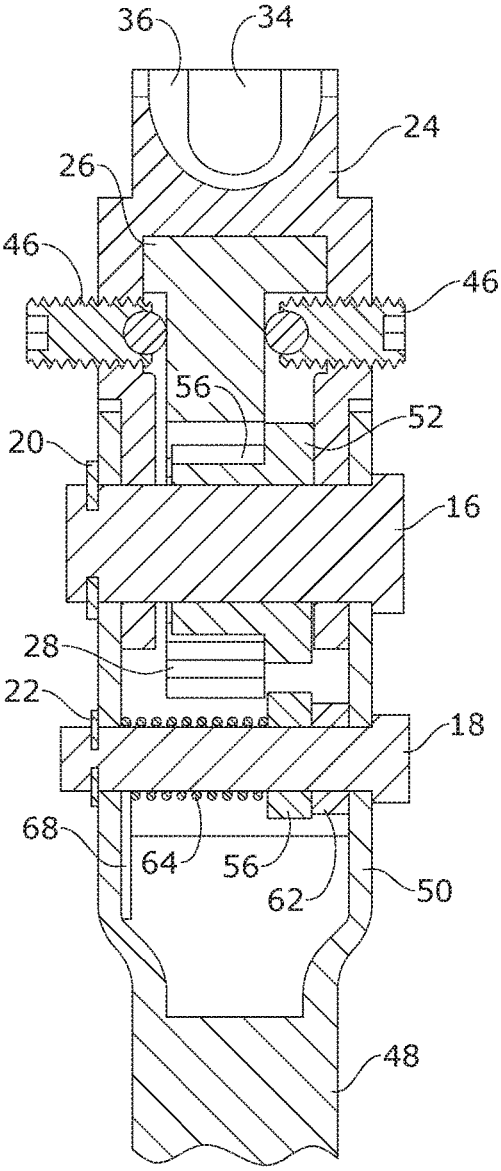
FIG. 10 shows a section view of one embodiment of the present invention.

By way of example, and referring to FIGS. 1-10, one embodiment of a pipe connector wrench further comprises a first handle arm 10 joined to a first handle grip 12 and a first handle head 14. The first handle head 14 further comprises a first handle large upper opening and a first handle small lower opening.

A first clamp head 24 is joined to a first clamp head tongue 26 having clamp head teeth 28. The first clamp head 24 further comprises a first clamp head upper opening 30 and a first clamp head lower opening 32. The first clamp head 24 further comprises a connector cap slot 34 and a tube slot 36.

A first large pivot pin 16 is inserted through the first handle large upper opening and the first clamp head upper opening 30 and is held in place with a first large retaining ring 20. A first small pivot pin 18 is inserted through the first handle small lower opening and the first clamp head lower opening 32 and is held in place with a first small retaining ring 22.

A second head clamp 38 further comprises a second large pin slot 40, a second connector cap slot 42 and a second tube slot 44. A pair of springs 46 fit into a pair of spring slots on the second head clamp 38.

A second handle arm 48 is joined to a second handle grip 12 and a second handle head 50. The second handle head 50 further comprises a second handle large upper opening and a second handle first small lower opening and a second handle second small lower opening.

A second large pivot pin 16 is inserted through the second handle large upper opening and the second clamp head upper opening and is held in place with a second large retaining ring 20. A gear 52 is joined to a ratchet 54. The ratchet 54 is arranged through the second handle first small lower opening.

A pawl further comprises a pawl body 56 with a pawl tooth 58 and is joined to a pawl arm 60. A second small pivot pin 18 is arranged through the second handle second small lower opening, a pawl spacer 62, and the pawl body 56 and is held in place with a second small retaining ring 22.

A torsion spring 64 further comprises a torsion spring hook 66 and a torsion spring leg 68. The torsion soring 64 is arranged around the second small pivot pin 18 such that the torsion spring hook 66 wraps around the pawl arm 60.

In use, a tube connector 70 further comprises a first connector cap 72 arranged against the first connector cap slot 34 and a second connector cap 72 arranged against the second connector cap slot 44 with a connector sleeve 74 arranged therebetween along a tube 76. The user 78 squeezes the first handle arm 10 toward the second handle arm 48 to push the first connector cap 72 to the second connector cap 72 and thus crimping a first tube 76 to a second tube 76.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A tube connector crimping tool, configured to enable a user to crimp a first refrigeration tube having a first connector cap to a second refrigeration tube having a second connector cap with one hand; the tube connector crimping tool comprising:

a first handle arm joined to a first handle head;

a first head clamp, further comprising a clamp head tongue, joined to the first handle head, and clamp head teeth;

a gear, immediately adjacent to the clamp head teeth and joined to a ratchet;

a second handle head, joined to the ratchet and a second handle arm;

a second head clamp, joined to the second handle head and further comprising a pair of spring arranged adjacent to the first head clamp tongue;

wherein squeezing the second handle arm toward the first handle arm crimps the first refrigeration tube to the second refrigeration tube.

2. The tube connector crimping tool of claim 1, wherein the first clamp head further comprises:

a first clamp head upper opening a first clamp head lower opening a first connector cap slot, immediately adjacent to the first connector cap; and a tube slot, immediately adjacent to the first tube.

3. The tube connector crimping tool of claim 2, further comprising:

a first large pivot pin, inserted through a first handle large upper opening and a first clamp head upper opening and held in place with a first large retaining ring; and a first small pivot pin, inserted through a first handle small lower opening and a first clamp head lower opening and held in place with a first small retaining ring.

4. The tube connector crimping tool of claim 3, further comprising:

a second large pivot pin, inserted through a second handle large upper opening and a second clamp head upper opening and held in place with a second large retaining ring;

wherein the ratchet is arranged through a second handle first small lower opening.

5. The tube connector crimping tool of claim 4, further comprising:

a pawl further comprising a pawl body with a pawl tooth and joined to a pawl arm;

a second small pivot pin, arranged through a second handle second small lower opening, a pawl spacer, and the pawl body and held in place with a second small retaining ring.

* * * * *